United States Patent [19]

Swann

[11] 4,241,244

[45] * Dec. 23, 1980

[54] ELECTRIC SWITCHES

[76] Inventor: David A. Swann, Cnr. Forster & Hardner Rds., Mount Waverley, Victoria, Australia, 3149

[ * ] Notice: The portion of the term of this patent subsequent to Mar. 30, 1996, has been disclaimed.

[21] Appl. No.: 863,176

[22] Filed: Dec. 22, 1977

[51] Int. Cl.[3] ..... H01H 21/00

[52] U.S. Cl. ..... 200/6 R; 200/11 K; 200/16 C; 200/67 G

[58] Field of Search ..... 200/1 R, 6 R, 6, 6 B, 200/67 G, 11 K, 16 C, 16 D, 276, 314, 315, 316, 317, 239–242

[56] References Cited

U.S. PATENT DOCUMENTS

| | | | |
|---|---|---|---|
| 1,818,987 | 8/1931 | Duffy | 200/11 K X |
| 2,966,560 | 12/1960 | Gluck | 200/16 C |
| 3,072,757 | 1/1963 | Gluck | 200/16 |
| 3,271,535 | 9/1966 | Vananzi | 200/16 C |
| 3,461,252 | 8/1969 | Vananzi | 200/16 C |
| 3,535,478 | 10/1970 | Lewis | 200/67 G |
| 3,609,268 | 9/1971 | Sanchez | 200/315 |
| 3,679,847 | 7/1972 | House | 200/11 K X |
| 3,863,040 | 1/1975 | Van Benschoten et al. | 200/276 X |
| 4,027,119 | 5/1977 | Tezuka | 200/1 R X |
| 4,041,258 | 8/1977 | Harada | 200/16 C X |
| 4,072,834 | 2/1978 | Godfrey | 200/16 C |
| 4,104,494 | 8/1978 | Swann | 200/67 G |
| 4,145,586 | 3/1979 | Swann | 200/67 G |
| 4,147,908 | 4/1979 | Swann | 200/241 X |

*Primary Examiner*—James R. Scott

*Attorney, Agent, or Firm*—Andrus, Sceales, Starke & Sawall

[57] ABSTRACT

An electrical switch includes a casing, an actuator, and a switch mechanism. The switch mechanism includes a contact bridging member movable between a plurality of spaced electrical contacts. The contacts act as fulcrums on the contact bridging member during its movement to assist in making and breaking the electrical connections. A conductor connects the contact bridging member to one of the contacts or to a second switching mechanism mounted in a common housing.

18 Claims, 15 Drawing Figures

ELECTRIC SWITCHES

BACKGROUND OF THE INVENTION

1. Field of the Invention

This invention relates to electric switches.

In a particular aspect this invention relates to switches of the type shown in Australian Patent Applications Nos. 86860/75, 86865/75 and 86859/75 and the whole of the subject matter of the specifications thereof is to be considered as being imported into this specification. Australian Patent Application Nos. 86860/75, 86865/75 and 86859/75 correspond to U.S. patent application Ser. Nos. 755,584, 752,283 and 752,284 and German Patent Application No. P 25 52 358.4 . U.S patent application Ser. No. 752,283 has issued as U.S. Pat. No. 4,104,494. U.S. patent application Ser. No. 752,284 has issued as U.S. Pat. No. 4,145,586.

I have found a need to supply such electric switches which are capable of performing certain switching operations and have found great difficulty in supplying such switches economically and in avoiding the use of complex external connections to achieve the desired circuits.

SUMMARY OF THE INVENTION

The present invention provides an electric switch comprising a casing, an actuator and a switch mechanism including a contact bridging member capable of being moved along a path by the actuator, and two spaced apart electric contacts arranged along said path; wherein one of said contacts functions, in use, as a fulcrum, and wherein said contact bridging member is so shaped and said electric switch is so constructed and arranged such that said contact bridging member is movable from a first position in which it is in contact with said contacts, slideably with respect to said contacts and in so doing pivots about said fulcrum to come out of contact with the other of said contacts; and wherein circuit means is provided within the casing forming a circuit between said contact bridging member and an electrical conductor being part of said electric switch in aii positions of said contact bridging member.

PREFERRED ASPECTS OF THE INVENTION

Said electrical conductor may be one of said two spaced apart contacts. Alternatively, said electrical conductor may be one of one or more further contacts spaced apart from said two spaced apart contacts and which said one or more further contacts may be contacted by said contact bridging member in moving along said path.

In a specific instance of this last, the present invention provides, in a first aspect, an electric switch comprising a casing, an actuator, a contact bridging member capable of being moved along a path by the actuator and four spaced apart electric contacts arranged along said path; wherein the central two of said contacts intermediate the outer two of said contacts function, in use, as fulcrums and wherein said contact bridging member is so shaped and said electric switch is constructed and arranged such that said contact bridging member is movable, from a first position in which it is in contact with one of said outer two of said contacts and the adjacent one of said central contacts, to a second position in which it is in contact with said central contacts and to a third position in which it is in contact with the outer of said other two of said contacts and the adjacent central contact; and wherein the contact bridging member, in so moving, moves slideably with respect to any two of said contacts which it contacts and in so doing pivots about one of the central contact fulcrums to come out of contact with one of said contacts and to come into contact with another of said contacts; and wherein circuit means is provided within the casing forming a circuit between one of said contacts and said contact bridging member in each of said first, second and third positions.

The circuit is preferably between one of said contacts which is at an end of the path and said contact bridging member.

Said circuit means preferably includes a flexible conductor.

The actuator is preferably arranged to move by pivoting about an axis and the flexible conductor is preferably arranged to flex relatively more adjacent to said axis than to said contact bridging member.

It is preferred that said actuator is hollow and that said circuit means includes a conductor which passes within the hollow actuator.

The switch may, if desired, have more than four contacts arranged along the path.

Two such switches within a common casing and sharing a common actuator may be provided.

Switches in accordance with said first aspect may be used as double pole switches and in progressive switching applications where power is to be applied firstly to, say, one power consuming unit and, secondly, to, say, that unit and another power consuming unit.

The present invention provides, in a second aspect, an electric switch comprising a casing, an actuator carried by the casing and a switch mechanism including a contact bridging member capable of being moved along a path by the actuator and first, second and third spaced apart electric contacts arranged along said path; wherein the first and second contacts function, in use, as fulcrums and wherein said contact bridging member is so shaped and the switch is constructed and arranged such that said contact bridging member is movable, from a first position in which it is in contact with the first contact, to a second position in which it is in contact with the first and second contacts and to a third position in which it is in contact with the second and third contacts; and wherein the contact bridging member, in so moving, moves slidably with respect to one of said fulcrums and in so doing pivots thereabout to come out of contact with one of said contacts and/or to come into contact with another of said contacts; and wherein circuit means is provided within the casing forming a circuit between an electric contact and said contact bridging member in each of said first, second and third positions.

Said electric contact may be one of the first, second and third contacts but may be another contact.

The electric switch may include a number of such mechanisms but a particularly preferred switch has only one of said mechanisms and finds applications as a single pole switch in a circuit requiring it to have an off position, a position in which current is supplied to a first power consuming unit and another position in which current is supplied to said first power consuming unit and to a second power consuming unit.

Alternatively, said electrical conductor comprises a contact bridging member of another such switch mechanism.

In a specific instance of this last, the present invention provides, in a third aspect, an electric switch comprising a casing, an actuator, two switch mechanisms each comprising a contact bridging member capable of being moved along a path by the actuator and two spaced apart electric contacts arranged along said path; wherein one of said contacts of each mechanism function, in use, as a fulcrum and wherein each contact bridging member is so shaped and the said electric switch is constructed and arraged such that the contact bridging members are movable, from a first position in which they are in contact with the respective said contacts, slideably with respect to the respective said contacts and in so doing pivot about the respective fulcrum to come out of contact with the respective other of said contacts; and wherein circuit means is provided within the casing forming a circuit between the two contact bridging members in all positions of the two contact bridging members.

It is preferred that the circuit is formed between the two contact bridging members in regions thereof intermediate the ends and in this respect it is most preferred that the circuit is formed in the region of the pivot axis of the contact bridging members.

It is particularly preferred that the actuator is hollow and that a conductor forming at least part of the circuit is located within the hollow actuator.

Specific constructions in accordance with this invention will now be described with the aid of the accompanying drawings.

DETAILED DESCRIPTION

Figure 1:
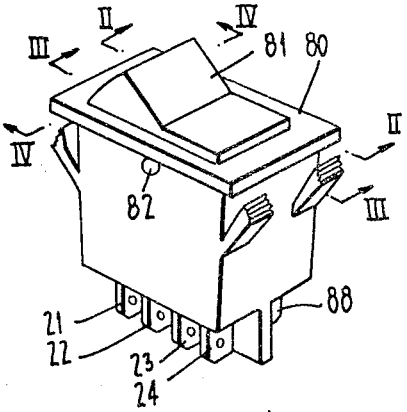
FIG. 1 is a perspective view of a switch.
Figure 2:
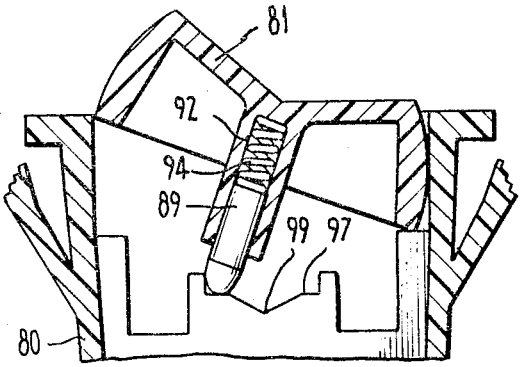
FIG. 2 is a cross-section on line II—II in FIG. 1.
Figure 3:
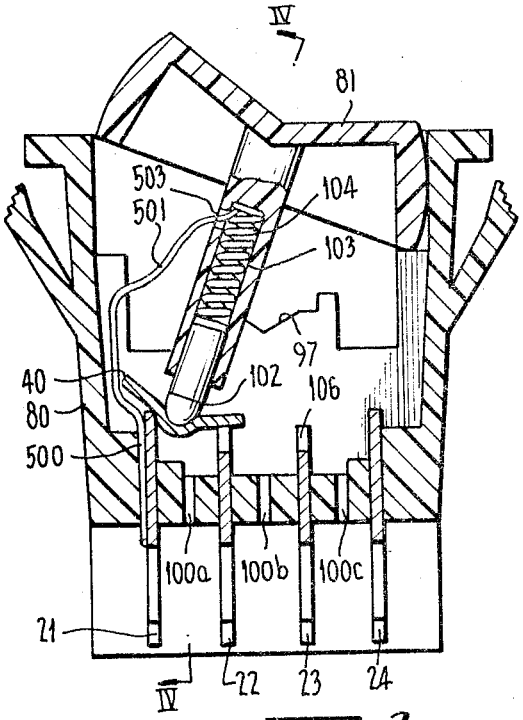
FIG. 3 is a cross-section on line III—III in FIG. 1.
Figure 4:
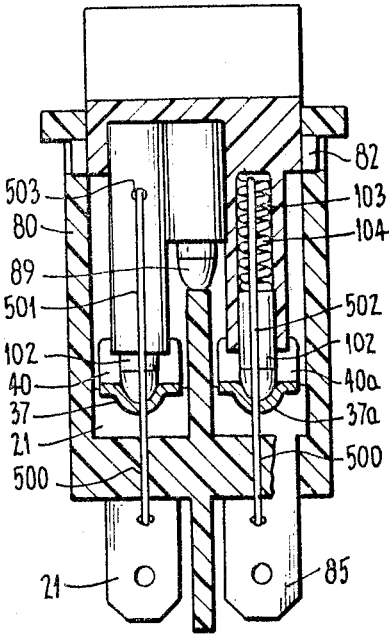
FIG. 4 is a cross-section on line IV—IV in FIGS. 1 and 3.

The switch shown in FIGS. 1–4 comprises a body 80 in which an operator 81 is pivotally mounted by means of pivot pins 82. The body carries contacts 21–24 and it is to be noted that contacts 21 and 24 lie at a higher level than contacts 22 and 23. The body also has contacts 85, 86, 87 and 88 which lie behind, respectively, contacts 21, 22, 23 and 24 in FIG. 3 and one of which, 88, is shown in FIG. 1 and another of which, 85, is shown in FIG. 4.

Operator 81 is provided with a pin 89 which is slideably received in a bore 92 and is spring loaded by a spring 94. The pin 89 follows a cam surface 97 formed on an intermediate wall in the body 80 and co-operates with a depression 99 in that cam surface to stabilize the operator 81 when it is in a central position.

The switch also includes a contact bridging member 40 and it is to be noted that it has a dunk 37 in its centre , see FIG. 4, which accommodates a pin 102 carried in a bore 103 in operator 81 and which pin 102 is spring loaded by a spring 104. The bridging member for contacts 85–88 is of the same shape and is identified by reference numeral **40*a*. It, too, has a dunk 37*a* equivalent to 37** for a similar reason.

To enable dunks 37 and **37*a* to pass, contacts 22, 23, 86 and 87 are slotted at 106**.

It will also be observed that the switch shown in FIGS. 1–4 differ from switches shown in said applications and patents in that two flexible woven copper braids 501 and 502 extend through holes 500 in the body. At one end those braids are soldered to contacts 21 and 85 respectively and, at their other ends pass through holes 503 into the bores 103 and are soldered to the respective springs 104. It is also to be noted that the pins 102 are made of metal so as to be conducting. Thus, a circuit between contact 21 and member 40 is made and a circuit between contact 85 and member **40*a*** is made.

However, it is to be noted that the aforesaid circuits modify the manner in which the switch may be used.

Figure 5:
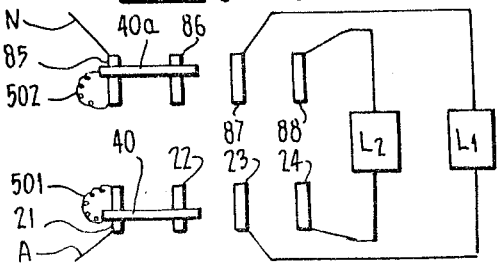
FIG. 5 is a schematic representation of a circuit achievable by the switch of FIGS. 1–4.

One example of the use of the switch shown in FIGS. 1–4 is the circuit shown in FIG. 5. In that circuit contacts 21–24 and 85–88 are represented as are the braids 501–502, "A" means active or line supply and is connected to contact 21, "N" means neutral and is connected to contact 85, a first load $L_1$ is connected, externally, between contacts 23 and 87 and a second load $L_2$ is connected, externally, between contacts 24 and 88.

When the members 40 and **40*a* bridge contacts 21 and 22, and 85 and 86 there is no circuit and no current flow. When members 40 and 40*a* bridge contacts 22 and 23, and 86 and 87 current flows to $L_1$ and when members 40 and 40*a* bridge contacts 23 and 24, and 87 and 88** current flows to both $L_1$ and $L_2$.

Modifications of the circuit of FIG. 5 include connecting contacts 21 and 85 to active and connecting loads, via earth returns, to any of contacts 22–24 and 86–88 but, generally, only to contacts 23, 24, 87 and 88.

In the switch shown in FIGS. 1–4 it is to be noted that the braids will flex in the region of the pivot pins 82 rather than in the regions of the members 40 and **40*a***.

In a modification the pins 102 are replaced by other pins located on the outside of those parts having bores 103. This may facilitate forming the aforesaid circuits.

The switch shown in FIGS. 6–9 is similar to that shown in FIGS. 1–4 and operates in similar manner but it is to be noted that a single copper braid 601 extends through holes 503 and is soldered, at its ends, to the springs 104. Thus a circuit between members 40 and **40*a*** is established.

Figure 10:
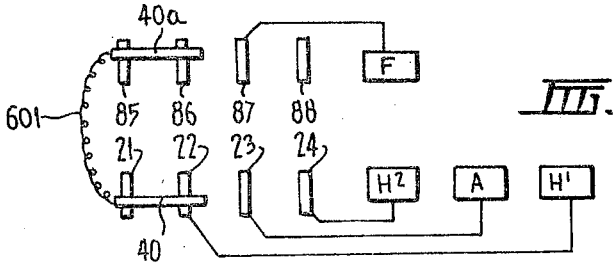
FIG. 10 is a schematic representation of a circuit achievable by the switch of FIGS. 6–9, FIGS. 11–13 are schematic representations of switches and circuits.

The switch shown in FIGS. 6–9 enables the circuit of FIG. 10 to be made. In FIG. 10 like references as in FIG. 5 represent like parts, the braid 601 is represented, $H_1$ and $H_2$ represent heater coils with earth return, F represents a fan. In this circuit contacts 21, 88 and 85 may be omitted. Active or line supply A is connected to contact 23.

In the circuit shown in FIG. 10 there will be no circuit when members 40 and **40*a* bridge contacts 21 and 22, and 85 and 86 (or are in equivalent position if contacts 21 and 85 are omitted). When members 40** and 40*a* bridge contacts 22 and 23 and 86 and 87 power will be supplied to heater coil $H_1$ and to fan F and when members 40 and 40*a* bridge contacts 23 and 24 and 87 and 88 power will be supplied to heater coil $H_2$ and to fan F.

In a modification of the switch shown in FIGS. 6–9, braid 601 is cut and a lamp is in series therewith and is located in the operator 81. In this instance active and neutral conductors are connected to contacts 23 and 87 and thus the lamp will light when members 40 and 40*a* are in contact with contacts 23 and 87. If desired, a further lamp may be located within the casing and is connected to contacts 24 and 88. That lamp will light when members 40 and 40*a* contact contacts 24 and 88. In conjunction with these lamps, contacts 21–24 and 85–88 may be variously connected.

Various modifications shown in said applications may be applied to the above switches.

In one modification of the above, the braids 501, 502 and 601 pass within the bores 103 into the respective pins 102 and terminate beneath the springs 104. In this arrangement, the springs 104 hold the braids in electrically conducting contact with the pins 102 and no soldered connection need be made.

In another modification, larger pins than 102 are used and fit over those parts of the operator 81 which have bores 103. In this arrangement, an electrical connection equivalent to braid 601 is made between the outer surfaces of those larger pins or those larger pins are connected equivalently to braids 501 and 502 via their external surfaces to the contact bridging members 40 and 40*a*.

The switches of FIGS. 11–14 are substantially the same as the switch of FIGS. 1–4 and like numerals denote like parts excepting that contacts 85–88, braid 502, bridging member 40*a* and parts associated therewith are omitted. Thus, the switch is a single pole switch having only a single contact bridging member 40.

Figure 11:
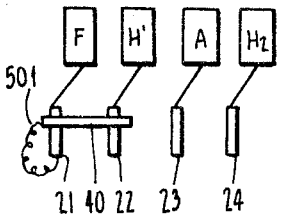

In the case of FIG. 11, "A" means active or line supply and is connected to contact 23. Further, a fan, F, provided with an earth return is connected to contact 21, a first heater coil H1 is connected to contact 22 and a second heater coil H2 is connected to contact 24. The heater coils have earth returns.

When the member 40 bridges contacts 21 and 22, current is not supplied to any of F, H1 and H2 and the switch is in an "off" position.

With the member 40 bridging contacts 22 and 23, current will be supplied to H1, and, via braid 501, to F.

When the member 40 bridges contacts 23 and 24, current will be supplied to H2 and, via braid 501, to F.

It will be realized that the circuit shown in FIG. 11 is effectively the same as that of FIG. 10 excepting that a simpler, and thus cheaper, switch is used.

Figure 12:
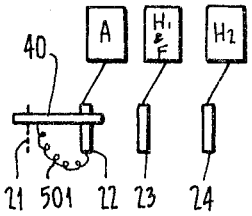

The switch and circuit shown in FIG. 12 is identical to that of FIG. 11 and like reference numerals denote like parts except that contact 21 is eliminated, although it is to be noted that the member 40 can take up a position, as shown, in which it contacts only contact 22, active A is connected to contact 22, H1 and F are connected to contact 23, H2 is connected to contact 24 and braid 501 is connected to contact 22.

When the member 40 is in the position shown, no current will flow and that is an "off" position.

When the member 40 bridges contacts 22 and 23, current flows to H1 and F.

When the member 40 bridges contacts 23 and 24, current flows, via braid 501, to H1, F and H2.

Figure 13:
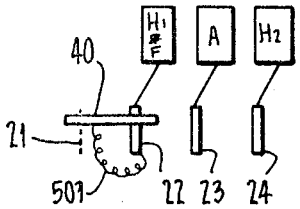

It is to be noted that when member 40 bridges contacts 23 and 24, all current flows through braid 501 and, as this may be considerable, the arrangement of FIG. 13 is preferred.

The switch and circuit of FIG. 13 is identical to that of FIG. 12 and like reference numerals denote like parts except that H1 and F are connected to contact 22, active A is connected to contact 23 and H2 is connected to contact 24.

When the member 40 is in the position shown in FIG. 13, no current flows and the switch is in an off position.

When the member 40 bridges contacts 22 and 23 current flows to H1 and F.

When the member 40 bridges contacts 23 and 24 current flows to H2 and, via braid 501, to H1 and F.

It is to be noted that in the FIG. 13 configuration that when member 40 bridges contacts 23 and 24 only that part of the total current flow required by H1 and F passes through the braid 501.

The above described switches are of simple and cheap construction. The switches will find application in heaters fitted with fans and as switches for lights of automobiles in that the switch can have an off position, a position in which only side or parking lights are on and a position in which side or parking lights and head lights are on. Many other applications will also be found for those switches.

Figure 14:
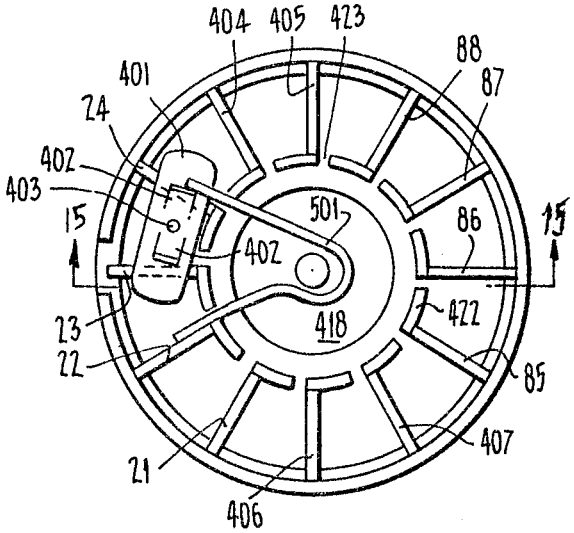
FIG. 14 is a broken away plan view of another embodiment of the switch of the present invention.
Figure 15:
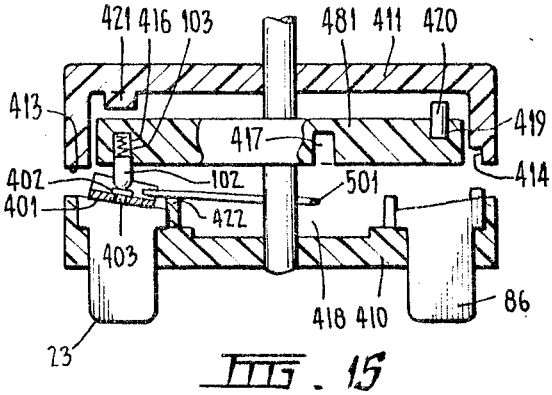
FIG. 15 is a cross-sectional view taken along the line 15—15 of FIG. 14.
Figure 6:
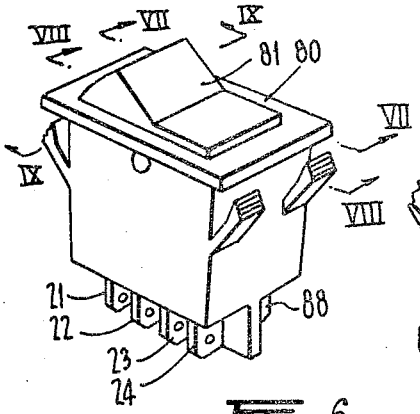
FIG. 6 is a perspective view of another switch in accordance with this invention.
Figure 7:
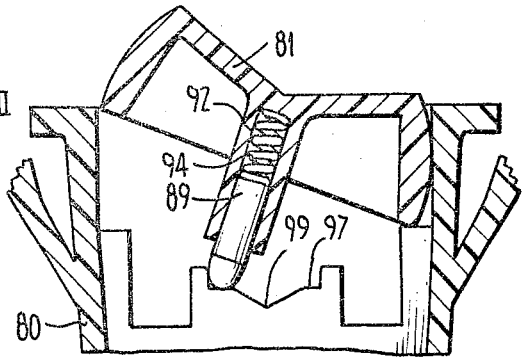
FIG. 7 is a cross-section on lines VII—VII in FIG. 5.
Figure 8:
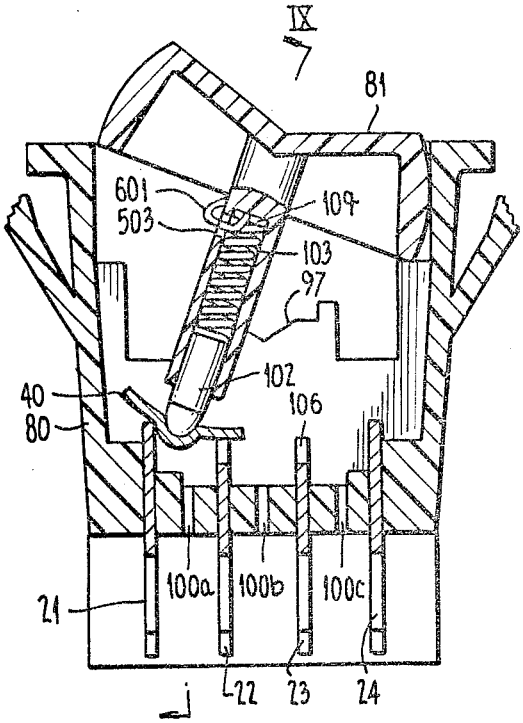
FIG. 8 is a cross-section on line VIII —VIII in FIG. 6.
Figure 9:
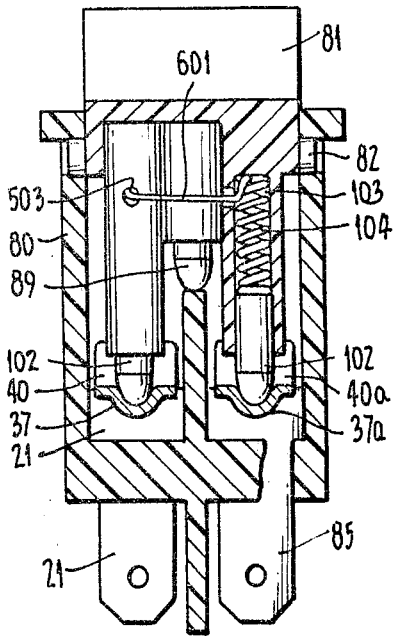
FIG. 9 is a cross-section on line IX—IX in FIGS. 6 and 7.

A further switch is shown in FIGS. 14 and 15.

FIG. 15 is a cross-sectional, partly exploded view of the switch the section being on line 15—15 in FIG. 14.

The switch shown in FIGS. 14 and 15 is similar to those switches previously described and operates similarly.

In FIGS. 14 and 15, reference numerals the same as those used in respect of FIGS. 1–4 denote like parts.

The principal difference between the switch of FIGS. 14 and 15 and that of FIGS. 1–4 is that it is a rotary switch.

Other differences are as noted below.

The contact bridging member 401 has upstanding lugs 402 and a hole 403. The hole appears to assist operation. The pin 103 which is spring loaded by spring 104 does not substantially project through the hole 403.

In addition to contacts 21–24 and 85–88, there are also contacts 404–407. Each contact has an inclined upper surface and in consequence the member 401 does not need to be arcuate as viewed in FIG. 15. Any one of the contacts can be removed. The switch includes a lower and an upper body part 410 and 411, a locating lug 412, a locating notch 413 and an abutment 414 which overlies the contacts and holds them in place. The switch further comprises an actuator 481 having a plurality of bores on its underside (one of which is shown as 416) for receiving the pin 102 and spring 104 or further such pins and springs, at least one further bore 417 on its underside for receiving a pin and spring similar to 102 and 104 for contacting, if desired, an annular or part-annular contact located in well 418, and a plurality of bores on its upper side (one of which is shown as 419) for receiving a pine 420 or further such pins and which pin 420 or further such pins can co-operate with a lug 421 to restrict rotation of the actuator. The well 418 is defined in part by an upstanding wall 422 having slots 423 through which connectors can pass and through one of which braid 501 passes to make contact between contact 22 and the contact bridging member 401.

Modifications and adaptations may be made to the above described without departing from the spirit and scope of this invention which includes every novel feature and combination of features disclosed herein.

The claims form part of the disclosure of this specification.

I claim

1. An electric switch having a mechanism comprising an actuator (81, 89, 102–104): a contact bridging member (40) capable of being moved along a path by said actuator: at least two spaced apart electric contacts (21, 22) arranged along the path wherein one of the contacts (22) functions, in use, as a fulcrum; said actuator applying force to said member at an area (37) intermediate its ends and on one side thereof; said member having an opposite side which, in use, engages said contacts, said opposite side being comprised of first and second surface portions which are at an angle to one another diverging from said path; said surface portions, in a first position of said member, engaging respective ones of said contacts and at least one such surface portion being inclined to a straight line extending between the surfaces of said contacts which are engaged by said member when in said first position and said area (37) of said contact bridging member being located to the side of said fulcrum adjacent the other of the contacts, whereby a part of said member nests closely with and between said contacts; said force being applied by said actuator to said member in a direction urging said part of said member into such nesting relation; said member (40) being movable, from said first position, slideably with respect to said contacts and in so doing the trailing one of said surface portions moves with a component of motion in the direction of said force such that said member initially rotates in one direction, said part moving to become relatively less nested and does so against the action of said force tending to restore it to the nested condition, said area approaching said fulcrum and thereafter, after said area has passed said fulcrum, said member pivoting about said fulcrum in the opposite direction whereby it disengages from the other of the contacts; and said electric switch further including circuit means (501) forming a circuit between an electrical contact and said contact bridging member.

2. An electrical switch as claimed in claim 1 wherein said circuit means is further defined as forming a circuit between an electrical contact connectable to the power line and said contact bridging member.

3. An electrical switch as claimed in claim 1 wherein said circuit means is further defined as forming a circuit between an electrical contact connectable to an electrical load and said contact bridging member.

4. An electrical switch as claimed in claim 1 including a second mechanism which is a replica of the first described mechanism, said mechanism sharing a common casing and using the same actuator whereby both mechanisms may be simultaneously operated by said actuator.

5. An electric switch as claimed in claim 4 wherein said circuit means comprises a contact bridging member of another such switch mechanism.

6. An electric switch as claimed in claim 1 wherein said path is circular.

7. An electric switch as claimed in claim 1 having: first, second and third electric contacts (22, 23, 24) sequentially spaced along said path, wherein said second and said third contacts (23, 24) function, in use, as fulcrums; said surface portions, in said first position of said member, engaging said first and second contacts with said area of said contact bridging member being located between said first and second contacts whereby a part of said member nests closely with and between said first and said second contacts; said member (40) being movable, from said first position to a second position whereby it disengages from said first contact by said rotating and pivoting motion and contacts said second and said third contact and in which second position said surface portions are similarly inclined to a straight line extending between the surfaces of said second and said third contacts which are engaged by member, said area (37) being similarly located between said second and said third contacts, and said part of said member similarly nests and is urged to nest by said force applied to said member by said actuator with and between said second and said third contacts; said member being slideably movable from said second position to a third position, similarly with an initial rotation in said one direction, similarly such that said part moves against said force to become relatively less nested and similarly pivots after said area has passed said third contact, as a fulcrum, in said opposite direction whereby it disengages from said second contact and comes to a third position in which it contacts said third contact and is out of mechanical contact with said first and second contacts.

8. An electrical switch as claimed in claim 7, wherein said circuit means is further defined as forming a circuit between an electrical contact connectable to the power line and said contact bridging member.

9. An electrical switch as claimed in claim 7 wherein said circuit means is further defined as forming a circuit between an electrical contact connectable to an electrical load and said contact bridging member.

10. An electrical switch as claimed in claim 7 including a second mechanism which is a replica of the first described mechanism, said mechanism sharing a common casing and using the same actuator whereby both mechanisms may be simultaneously operated by said actuator.

11. An electric switch as claimed in claim 10 wherein said circuit means comprises a contact bridging member of another such switch mechanism.

12. An electric switch as claimed in claim 7 wherein said path is circular.

13. An electric switch having a mechanism comprising an actuator (81, 89, 102–104): a contact bridging member (40) capable of being moved along a path by said actuator: first, second, third and fourth electric contacts (21–24) sequentially spaced along said path; wherein said second and said third contacts (22–23) function, in use, as fulcrums, said actuator applying force to said member at an area (37) intermediate its ends and on one side thereof; said member having an opposite side which, in use, engages said contacts, said opposite side being comprised of first and second surface portions which are at an angle to one another diverging from said path; said surface portions, in a first position of said member, engaging said first and second contacts and at least one such surface portion being inclined to a straight line extending between the surfaces of said first and said second contacts which are engaged by said member when in said first position and said area (37) of said contact bridging member being, in said first position, located to the side of said second contact adjacent said first contact whereby part of said member nests closely with and between said first and said second contacts, said force being applied by said actuator to said member in a direction urging said part into such nesting relation; said member (40) being movable, from said first position, slideably with respect to said first and said second contacts and in so doing the trailing one of said surface portions moves with a component of motion in the direction of said force such that said member initially rotates in one direction, said part moving to become relatively less nested and does so against the action of said force tending to restore it to the nested condition, said area approaching said second contact, and thereafter after said area has passed said second contact said member pivots about said second contact, as a fulcrum, in the opposite direction whereby it disengages from said first contact and comes to a second position in which it contacts said second and said third contact: and in which second position said surface portions are similarly inclined to a straight line extending between the surfaces of said second and said third contacts which are engaged by said member, said are a (37) of said member being similarly located between said second and said third contacts, and said part of said member similarly nests and is urged to nest by said force applied to said member by said actuator with and between said second and said third contacts; said member (40) being slideably movable from said second position to a third position, similarly with an initial rotation in said one direction, similarly such that said part moves against said force to become relatively less nested and similarly pivots after said area has passed said third contact, as a fulcrum in said opposite direction whereby it disengages from said second contact and comes to a third position in which it contacts said third contact and said fourth contact in similar manner to the manner of contacting said first contact and said second contact: and said electrical switch includes circuit means (501) forming a circuit between one of said contacts and said contact bridging member in each of said first, second and third positions.

14. An electrical switch as claimed in claim 13 wherein said circuit means is further defined as forming a circuit between an electrical contact connectable to the power line and said contact bridging member.

15. An electrical switch as claimed in claim 13 wherein said circuit means is further defined as forming a circuit between an electrical contact connectable to an electrical load and said contact bridging member.

16. An electrical switch as claimed in claim 13 including a second mechanism which is a replica of the first described mechanism, said mechanism sharing a common casing and using the same actuator whereby both mechanisms may be simultaneously operated by said actuator.

17. An electric switch as claimed in claim 16 wherein said circuit means comprises a contact bridging member of another such switching mechanism.

18. An electric switch as claimed in claim 13 wherein said path is circular.

* * * * *